US005435214A

United States Patent [19]

Sisson

[11] Patent Number: 5,435,214

[45] Date of Patent: Jul. 25, 1995

[54] ADJUSTABLE LOCKING PLIER

[76] Inventor: Clarence E. Sisson, Rte. 2, Box 339, Bealeton, Va. 22712

[21] Appl. No.: 315,508

[22] Filed: Sep. 30, 1994

Related U.S. Application Data

[63] Continuation of Ser. No. 144,437, Nov. 2, 1993, abandoned.

[51] Int. Cl.[6] ..... B25B 7/12

[52] U.S. Cl. ..... 81/376; 81/370; 81/383; 294/22

[58] Field of Search ..... 81/345, 370, 374, 376–380, 81/383; 294/19.1, 22

[56] References Cited

U.S. PATENT DOCUMENTS

| | | | |
|---|---|---|---|
| 1,301,185 | 4/1919 | Sorensen | 81/345 X |
| 1,519,938 | 12/1924 | Smith | 87/383 |
| 1,532,815 | 4/1925 | Hahn | 81/382 |
| 2,327,368 | 8/1943 | Olson | 81/374 |
| 3,600,936 | 8/1971 | Baldwin, Jr. | 81/370 |
| 3,654,755 | 4/1972 | Bell | 81/380 X |
| 4,289,050 | 9/1981 | Scafaro | 81/311 |
| 4,930,825 | 6/1990 | Dearman | 294/50.9 |

FOREIGN PATENT DOCUMENTS

| | | |
|---|---|---|
| 2234701 | 2/1991 | United Kingdom . |
| WO82/03195 | 9/1982 | WIPO . |

*Primary Examiner*—James G. Smith
*Attorney, Agent, or Firm*—Bacon & Thomas

[57] ABSTRACT

A plier-type locking wrench has an elongated body having a pair of jaws at one end and a pair of handles at an opposite end. The pair of jaws includes a fixed jaw and a movable jaw. The pair of handles includes a fixed handle and a movable handle. A threaded member engages the fixed handle. An operating crank is pivotally attached to the body adjacent the fixed handle. The movable jaw is connected to the operating crank by a connecting rod. The movable handle is pivotally connected to the operating crank. A locking lever has a first end pivotally connected to the movable handle and a second end cammingly engageable with the threaded member. The movable handle is displacable relative to the fixed handle to displace the operating crank which, in turn, displaces the connecting rod and the movable jaw. The locking lever permits the movable jaw to be locked in a desire position relative to the fixed jaw. The threaded member is adjustable to adjust the locking position of the pivotal jaw. A release lever releases the movable jaw from its locked position.

13 Claims, 3 Drawing Sheets

ADJUSTABLE LOCKING PLIER

This application is a continuation of application Ser. No. 08/144,437, filed Nov. 2, 1993 now abandoned.

BACKGROUND OF THE INVENTION

1. Field of the Invention

The present invention relates to a tool and more particularly, to tool jaws positioned by relatively movable plural handles which have a spring-urged lock release.

2. Description of the Prior Art

Plier-type locking wrenches include tool jaws operable by a pair of handles. In operation, a locking lever locks a pivotal jaw in a position relative to a stationary jaw. A release lever releases the pivotal jaw from its locked position. Upon release of the pivotal jaw, a spring urges the pivotal jaw away from the stationary jaw. A threaded member cammingly engages the locking lever and is adjustable to adjust the locking position of the pivotal jaw.

Various plier-type locking wrenches have been devised. PCT Publication No. WO 82/03195, published Sep. 30, 1982, to Philippe Poux, discloses clamping pliers which meet the described plier-type locking wrench set forth above. Another tool similar to that described above is disclosed in U.K. Patent Application No. GB 2 234 701 A, published Feb. 13, 1991, to Ralph Peterson, who further discloses a rapid jaw adjustment mechanism for adjusting the position of the movable jaw relative to the fixed jaw. An expansion tool similar to the plier-type locking wrench set forth above is disclosed in U.S. Pat. No. 4,289,050, issued Sep. 15, 1981 to Vincent J. Scafaro. This expansion tool further includes an arrangement of spreading members engageable with the jaws of the plier-type locking wrench.

A self-adjusting locking wrench is disclosed in U.S. Pat. No. 3,600,986, issued Aug. 24, 1971 to Earl M. Baldwin, Jr. In contrast to the aforementioned threaded member, the self-adjusting locking wrench includes a self-adjusting locking unit interconnected between two handle units. The self-adjusting locking unit includes a toggle link. The toggle link cooperatively engages a spring biased, adjustable wedge and plate arrangement to automatically adjust the desired clamping pressure of the jaws.

A rope splicing implement structured and configured similar to that of the aforementioned plier-type locking wrench is disclosed in U.S. Pat. No. 3,654,755, issued Apr. 11, 1972 to Clarence R. Bell. Unlike the plier-type locking wrench, the handles of the rope splicing implement are operable to open the jaws; a threaded bolt is adjustable to vary the opening distance of the jaws; a tension spring maintains the jaws in an open position; and a release lever releases the jaws from the open position.

The foregoing implements are not satisfactory for use in narrowly confined areas where a plier-type locking wrench of extended length would be suitable. Tongs render possible the manipulation of one jaw relative to another jaw over an extended length. For example, U.S. Pat. No. 1,532,815, issued Apr. 7, 1925 to William J. Hahn, discloses tongs having jaws operable by a pair of handles. An adjustable connecting rod connects a movable jaw to a movable handle. The movable jaw is displacable relative to a fixed jaw by the movable handle.

An apparatus similar in construction to the aforementioned tongs is shown in U.S. Pat. No. 4,930,825, issued Jun. 5, 1990 to Timothy C. Dearman. Dearman discloses an apparatus for uprooting plants. A first jaw is movable relative to a second jaw. A clevis arrangement is coupled to an actuating mechanism by a connecting rod. The second jaw is movable, via the clevis arrangement, in response to movements of the actuating mechanism.

Though Hahn and Dearman are satisfactory for use in narrowly confined areas where a tool of extended length is necessitated, neither Hahn nor Dearman disclose locking jaws.

None of the above inventions and patents, taken either singly or in combination, is seen to describe the instant invention as claimed.

SUMMARY OF THE INVENTION

A plier-type locking wrench has an elongated body having a pair of jaws at one end and a pair of handles at an opposite end. The pair of jaws includes a fixed jaw and a movable jaw. The pair of handles includes a fixed handle and a movable handle. A threaded member engages the fixed handle. The movable jaw is pivotally attached to the body adjacent the fixed jaw. An operating crank is pivotally attached to the body adjacent the fixed handle. The movable jaw is connected to the operating crank by a connecting rod. A movable handle is pivotally connected to the operating crank. A locking lever has a first end pivotally connected to the movable handle and a second end cammingly engageable with the threaded member. The movable handle is displacable relative to the fixed handle to displace the operating crank which, in turn, displaces the connecting rod and the movable jaw. The locking lever permits the movable jaw to be locked in a desired position relative to the fixed jaw. The threaded member is adjustable to adjust the locking position of the pivotal jaw. A release lever releases the movable jaw from its locked position.

The body is configured to substantially conceal the connecting rod. The body is rigid and, when viewed in the cross-section, forms an elongated, flattened O-shaped structure. The flattened sides impart enormous structural integrity opposing collapse under tension of the enclosed connecting rod. The structure of the body enables it to be more easily grasped. The smooth side of the body promotes the maneuverability of the locking wrench in close quarters. Moreover, the enclosure of the connecting rod promotes user safety.

Accordingly, it is a principal object of the invention to provide an elongated plier-type locking wrench including a body having a fixed jaw at one end and a fixed handle at an opposite end, a movable jaw connected to the body adjacent the fixed jaw, a operating crank connected to the body adjacent the fixed handle, a connecting rod connecting the movable jaw to the operating crank, and a movable handle connected to the operating crank for displacing the operating crank which, in turn, displaces the connecting rod and the movable jaw.

It is another object that the body be configured to substantially conceal the connecting rod.

It is another object that the body be rigid and in the form an elongated, flattened O-shaped structure, wherein the flattened sides impart enormous structural integrity opposing collapse under tension of the enclosed connecting rod.

It is yet another object that the elongated plier-type locking wrench be suitable for use in narrowly confined areas where a plier-type locking wrench is required and promotes the maneuverability in close quarters.

It is still another object that the body of the elongated plier-type locking wrench be easily grasped by a user and that the enclosure of the connecting rod promote user safety.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
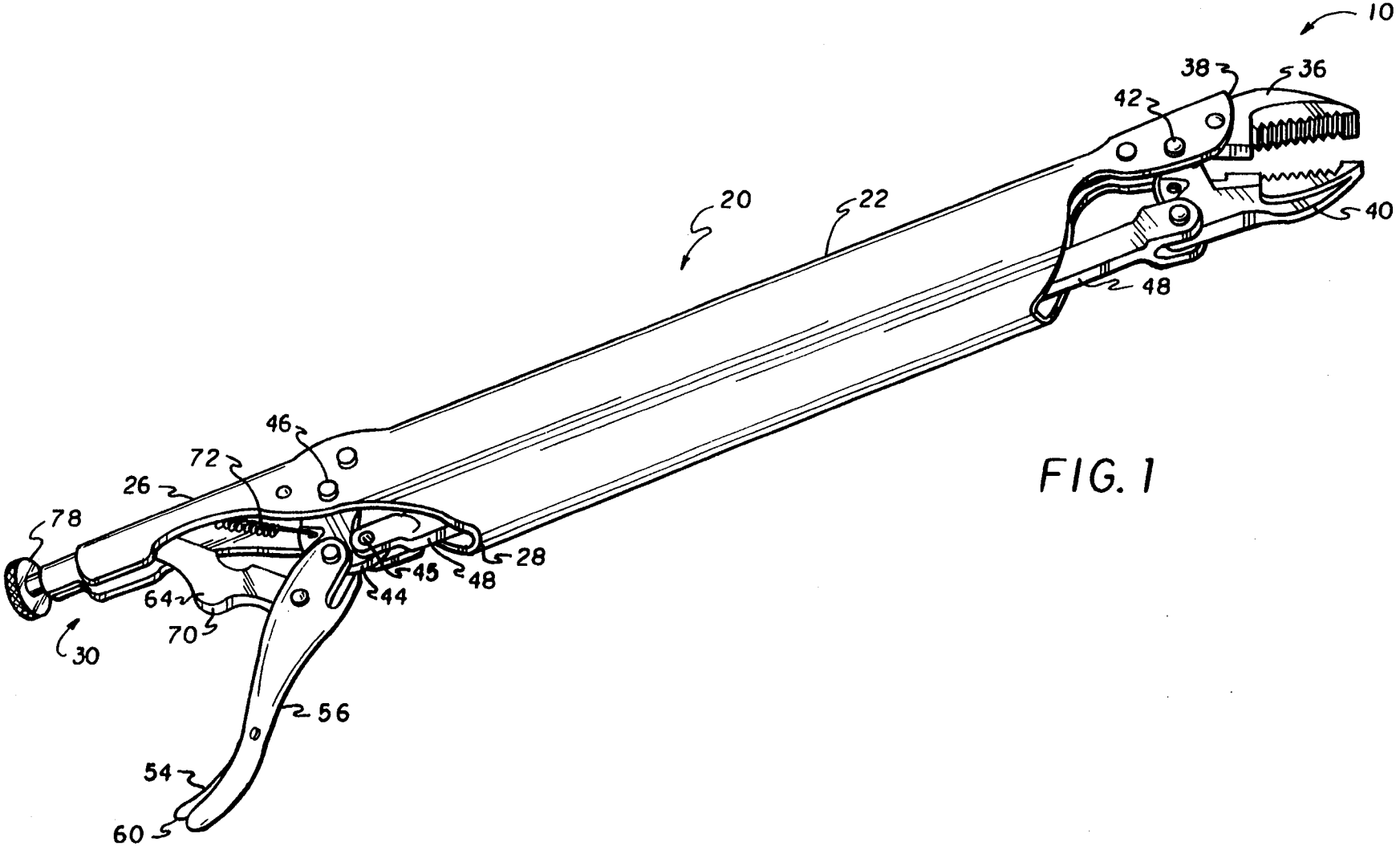
FIG. 1 is a side perspective view of an elongated plier-type locking wrench according to the present invention.
Figure 2:
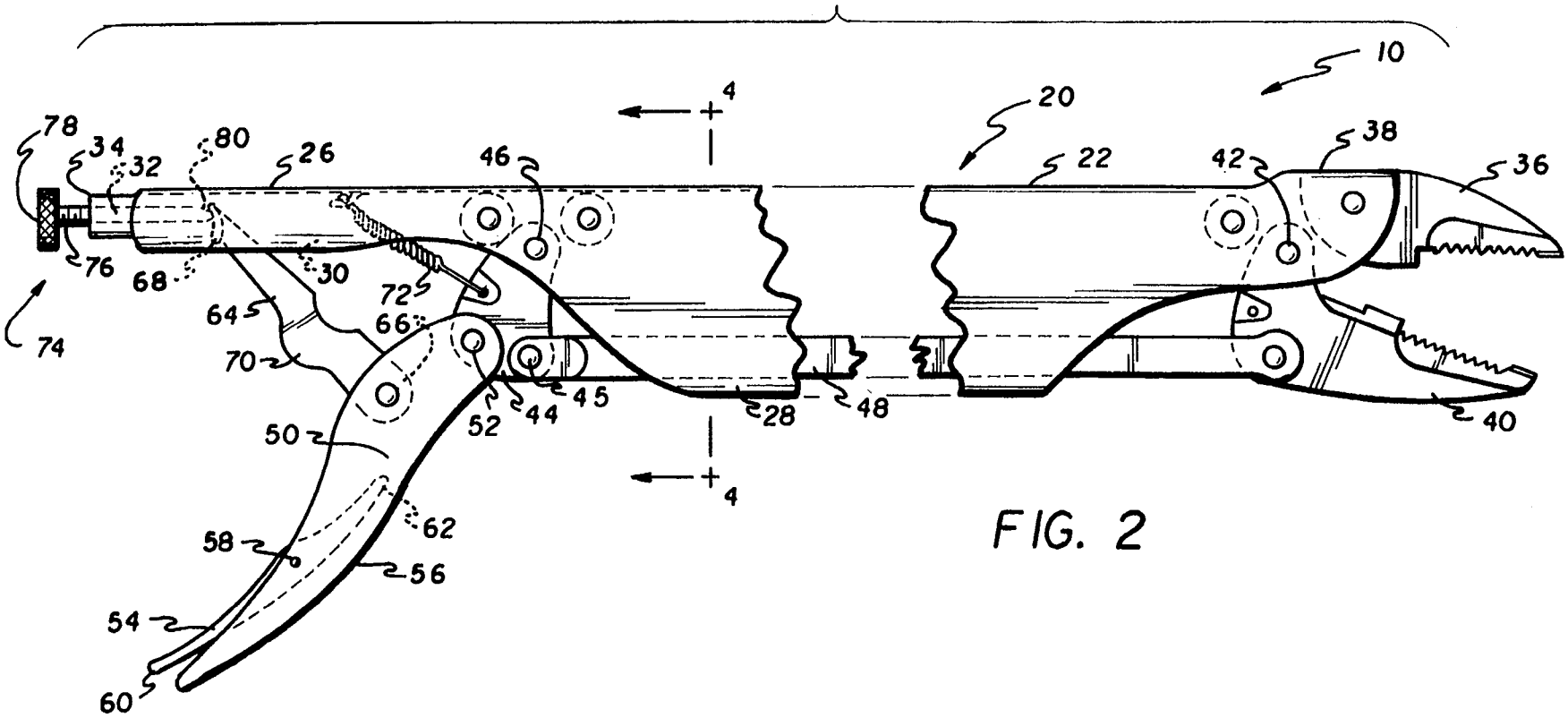
FIG. 2 is a partial cutaway, side elevational view of the locking wrench shown in FIG. 1, showing the components within the body thereof in hidden lines.
Figure 3:
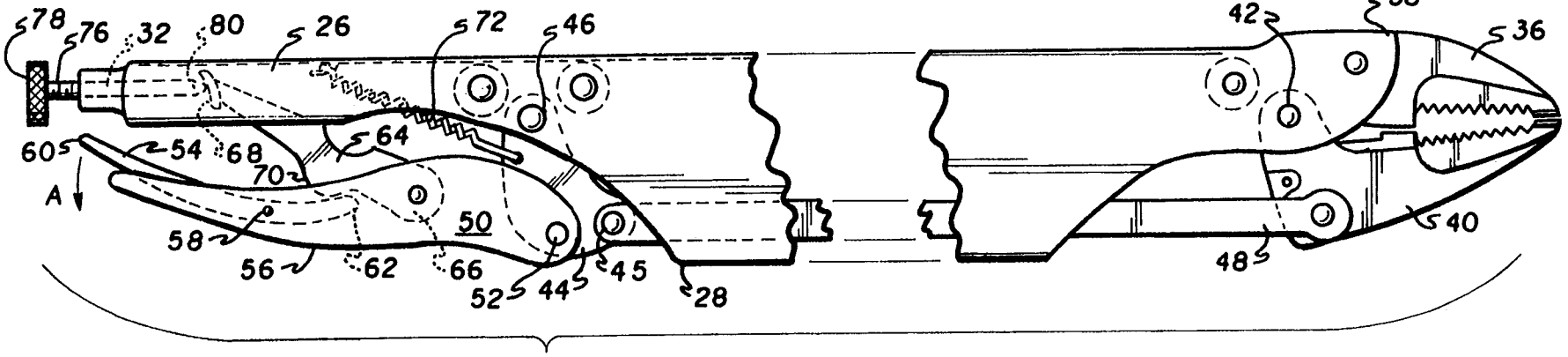
FIG. 3 is a partial cutaway, side elevational view of the locking wrench shown in FIG. 2 with the movable law in a closed position.
Figure 4:
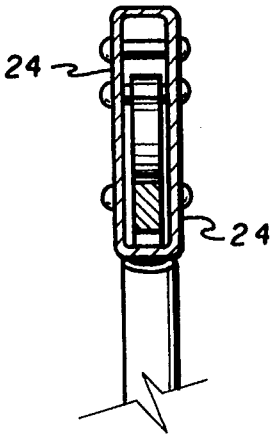
FIG. 4 is a cross-section view of the locking wrench drawn along lines 4—4 of FIG. 2.

The present invention, as is shown in FIGS. 1–3, is an elongated plier-type locking wrench 10. The locking wrench 10 includes an elongated body 20 having an intermediate bifurcated yoke portion 22. The bifurcated yoke portion 22 is bounded by side walls 24. The side walls 24 extend downwardly and are curved inwardly to form a substantially flattened, O-shaped structure, as is clearly shown in FIG. 4.

A substantially U-shaped body portion is bounded by the side walls 24 and is integral with a rear end 28 of the yoke portion 22. The U-shaped body portion forms an elongated fixed handle 26 having a recess 30 therein. The fixed handle 26 has an internally threaded aperture 32 in a rear end 34 thereof.

A stationary jaw 36 is integral with a forward end 38 of the elongated body 20. A triangularly shaped movable jaw 40 is pivotally connected by a first pivot pin 42 to the forward end 38 of the elongate body 20 adjacent the stationary jaw 36. The movable jaw 40 is operable to coact with the stationary jaw 36.

An operating crank 44 is pivotally connected by a second pivot pin 46 to the rear end 28 of the yoke portion 22 adjacent the fixed handle 26. A connecting rod 48 connects the movable jaw 40 to the operating crank 44 via a pivot pin 45. The operating crank 44 is operable to displace the connecting rod 48 and the movable jaw A rearwardly projecting movable handle 50 is pivotally attached to the operating crank 44 by a third pivot pin 52. The movable handle 50 is a substantially elongated U-shaped member. The movable handle 50 is operable to displace the operating crank 44.

A quick release lever 54 is pivotally attached to a medial portion 56 of the movable handle 50 by a fourth pivot pin 58. The quick release lever 54 has a free end 60 positionable in the substantially elongate U-shaped member 50 forming the movable handle 50. The quick release lever 54 further has a camming projection 62 extending forwardly of the fourth pivot pin 58.

A locking lever 64 has a forward end 66 pivotally secured to the movable handle 50 intermediate the third and fourth pivot pins 52 and 58. The locking lever 64 extends rearwardly into the recess 30 in the fixed handle 26 and has a camming surface 68 on a rear end thereof. The locking lever 64 further has a cam 70 engageable with the camming portion 62 of the release lever 54 upon locking the movable jaw 40 in a locked position as best shown in FIG 3. Upon displacement of the release lever 54 in a direction A away from the locking lever 64, the camming projection 62 is upwardly displaced about the fourth pivot pin 58 to counteract a cam engagement of the locking lever 64 with the camming projection 62 of the release lever 54.

A spring 72 has a forward end connected to the operating crank 44 intermediate the second and third pivot pins, the spring 72 extending rearwardly into the recess 30 in the fixed handle 26 and having a rear end engageable with the fixed handle 26, whereby the spring 72 provides resiliency to pull the jaws 36, 40 open when the free end 60 of the release lever 54 is moved towards the movable handle 50; in a direction A. An adjustable stop member 74 includes a threaded elongated member 76 having a knurled head 78 at a rear end thereof and a stop abutment 80 at a forward end. The stop member 74 is threadably engageable with the threaded aperture 32 in the fixed handle 26, and the stop abutment 80 is engageable with the camming surface 68 of the locking lever 64, whereby rotating the threaded member 76 in a forwardly direction increases a clamping pressure of the movable jaw 40 and rotating the threaded member 76 rearwardly decreases the clamping pressure of the movable jaw It is to be understood that the present invention is not limited to the sole embodiment described above, but encompasses any and all embodiments within the scope of the following claims.

I claim:

1. An elongated plier-type locking wrench comprising:

an elongated body having:

an intermediate bifurcated yoke portion, a substantially U-shaped body portion, a stationary jaw integral with a forward end of said elongated body;

a movable jaw pivotally connected by a first pivot pin to said forward end of said elongate body adjacent said stationary jaw, whereby said movable jaw is operable to coact with said stationary jaw;

an operating crank pivotally connected by a second pivot pin to a rear end of said elongate body adjacent a fixed handle;

a connecting rod connecting said movable jaw to said operating crank, whereby said operating crank is operable to displace said connecting rod and said movable jaw;

a rearwardly projecting movable handle pivotally attached to said operating crank by a third pivot pin; and a quick release lever pivotally attached to a medial portion of said movable handle by a fourth pivot pin, said quick release lever having a free end and a camming projection extending forwardly of said fourth pivot pin.

2. An elongated plier-type locking wrench as claimed in claim 1 wherein said bifurcated yoke portion is bounded by side walls, said side walls extending downwardly and being curved inwardly to form a substantially flattened, O-shaped structure.

3. An elongated plier-type locking wrench as claimed in claim 2 wherein said U-shaped body portion is bounded by said side wails and is integral with a rear end of said yoke portion, said U-shaped body portion forming an elongated fixed handle having a recess therein, said fixed handle having an internally threaded aperture in a rear end thereof.

4. An elongated plier-type locking wrench as claimed in claim 1, wherein said movable handle is a substantially elongated U-shaped member, whereby said movable handle is operable to displace said operating crank.

5. An elongated plier-type locking wrench as claimed in claim 3 further comprising a locking lever having a forward end pivotally secured to said movable handle intermediate said third and fourth pivot pins, said locking lever extending rearwardly into said recess in said fixed handle and having a camming surface on a rear end thereof, said locking lever having a cam engageable with said camming projection of said quick release lever upon locking said moveable jaw in a locked position, whereby upon displacement of said quick release lever in a direction away from said locking lever, said camming projection is upwardly displaced about said fourth pivot pin to counteract a cam engagement of said locking lever with said camming projection of said quick release lever.

6. An elongated plier-type locking wrench as claimed in claim 3 further comprising a spring having a forward end connected to said operating crank intermediate said second and third pivot pins, said spring extending rearwardly into said recess in said fixed handle and having a rear end engageable with said fixed handle, whereby said spring provides resiliency to pull said jaws open when said free end of said release lever is moved away from said movable handle.

7. An elongated plier-type locking wrench as claimed in claim 3 further comprising an adjustable stop member including a threaded member having a knurled head at a rear end and a stop abutment at a forward end, said stop member being threadably engageable with said threaded aperture in said fixed handle, said stop abutment being engageable with said camming surface of said locking lever, whereby rotating said threaded member forwardly increases a clamping pressure of said movable jaw and rotating said threaded member rearwardly decreases said clamping pressure of said movable jaw.

8. An elongated plier-type locking wrench comprising:

an elongated body having:

an intermediate bifurcated yoke portion, said bifurcated yoke portion being bounded by side walls, said side walls extending downwardly and curved inwardly to form a substantially flattened, O-shaped structure, and a substantially U-shaped body portion, said U-shaped body portion being bounded by said side walls and being integral with a rear end of said yoke portion, said U-shaped body portion forming an elongated fixed handle having a recess therein, said fixed handle having an internally threaded aperture in a rear end thereof;

a stationary jaw integral with a forward end of said elongated body;

a triangularly shaped movable jaw pivotally connected by a first pivot pin to said forward end of said elongated body adjacent said stationary jaw, whereby said movable jaw is operable to coact with said stationary jaw;

an operating crank pivotally connected by a second pivot pin to said rear end of said elongated body adjacent said fixed handle;

a connecting rod connecting said movable jaw to said operating crank, whereby said operating crank is operable to displace said connecting rod and said movable jaw;

a rearwardly projecting movable handle pivotally attached to said operating crank by a third pivot pin, said movable handle being a substantially elongated U-shaped member, whereby said movable handle is operable to displace said operating crank;

a quick release lever pivotally attached to a medial portion of said movable handle by a fourth pivot pin, said quick release lever having a free end positionable in said substantially elongated U-shaped member, said quick release lever further having a camming projection extending forwardly of said fourth pivot pin;

a locking lever having a forward end pivotally secured to said movable handle intermediate said third and fourth pivot pins, said locking lever extending rearwardly into said recess in said elongated fixed handle and having a camming surface on a rear end thereof, said locking lever having a cam engageable with said camming projection of said quick release lever upon locking said movable jaw in a locked position, whereby upon displacement of said free end of said quick release lever in a direction towards said movable handle, said camming projection is upwardly displaced about said fourth pivot pin to counteract a cam engagement of said locking lever;

a spring having a forward end connected to said operating crank intermediate said second and third pivot pins, said spring extending rearwardly into said recess in said fixed handle and having a rear end engageable with said fixed handle, whereby said spring provides resiliency to pull said jaws open when said free end of said quick release lever is moved towards said movable handle; and an adjustable stop member including a threaded member having a knurled head at a rear end and a stop abutment at a forward end, said stop member being threadably engageable with said threaded aperture in said fixed handle, said stop abutment being engageable with said camming surface of said locking lever, whereby rotating said threaded member forwardly increases a clamping pressure of said movable jaw, and rotating said threaded member rearwardly decreases said clamping pressure of said movable jaw.

9. An elongated plier-type locking wrench comprising:

an elongated body including a first end portion defining a first section of a handle of said locking wrench, an elongated central body portion and a second end portion;

a stationary jaw integrally formed with the second end portion of said elongated body;

a movable jaw pivotally connected to said elongated body adjacent said stationary jaw said movable jaw being adapted to coact with said stationary jaw;

an operating crank member pivotally connected to the first end portion of said elongated body;

a connecting rod having a first end portion pivotally connected to said operating crank member and a second end portion pivotally connected to said movable jaw such that pivotal movement of said operating crank member relative to said elongated body results in pivoting of said movable jaw relative to said stationary jaw;

a movable grip member defining a second section of the handle of said locking wrench, said movable grip member being pivotally attached to said operating crank member and shiftable relative to the first end portion of said elongated body to cause pivoting of said operating crank and said movable jaw into respective locking positions; and quick release means acting on said movable grip member and movable to release said operating crank and said movable jaw from said respective locking positions.

10. The locking wrench according to claim 9, wherein the second end portion of said elongated body includes a bifricated section, said movable jaw being pivotally connected to said bifricated section.

11. The locking wrench according to claim 9, wherein said connecting rod, between said operating crank member and said movable jaw, extends within said elongated body.

12. The locking wrench according to claim 11, wherein said movable grip member is further pivotally attached to the first end portion of said elongated body.

13. The locking wrench according to claim 9, wherein said quick release means comprises a lever pivotally attached to said movable grip member.

* * * * *